United States Patent [19]

Csontos

[11] Patent Number: 4,469,299

[45] Date of Patent: Sep. 4, 1984

[54] RAILWAY TURNOUTS

[76] Inventor: Imre Csontos, Durban, Natal, South Africa

[21] Appl. No.: 263,484

[22] Filed: May 14, 1981

[30] Foreign Application Priority Data

May 19, 1980 [ZA] South Africa ..... 80/2969

[51] Int. Cl.[3] ..... E01B 7/12

[52] U.S. Cl. ..... 246/435 R; 238/124; 238/143; 246/455; 246/458; 246/468; 246/471

[58] Field of Search ..... 246/455, 427, 421, 432, 246/469, 273–275, 382–384, 435 R, 435 A, 437, 438, 454, 460, 465, 466, 468, 436, 439, 440, 441, 442, 443, 444, 456, 457; 238/121, 122, 124, 17, 18, 20, 23, 143, 148, 147

[56] References Cited

U.S. PATENT DOCUMENTS

| | | | |
|---|---|---|---|
| 197,099 | 11/1877 | Cooke | 246/458 |
| 354,493 | 12/1886 | Stratton | 238/143 |
| 626,250 | 6/1899 | Taylor et al. | 246/437 |
| 1,185,739 | 6/1916 | Von Bartheld | 238/143 |
| 1,389,144 | 8/1921 | Keough | 246/468 |
| 1,763,472 | 6/1930 | Magee | 238/143 |
| 1,784,211 | 12/1930 | Vissat | 246/382 |
| 2,012,807 | 8/1935 | Caruthers | 246/455 |
| 4,005,839 | 2/1977 | Frank | 246/415 R |
| 4,362,282 | 12/1982 | Frank | 246/468 |

FOREIGN PATENT DOCUMENTS

| | | | |
|---|---|---|---|
| 122052 | 3/1931 | Austria | 246/471 |
| 1186069 | 2/1959 | France | 246/454 |
| 368819 | 6/1963 | Switzerland | 246/468 |
| 578390 | 10/1977 | U.S.S.R. | 246/454 |

*Primary Examiner*—Joseph F. Peters, Jr.
*Assistant Examiner*—Mitchell J. Hill

[57] ABSTRACT

According to the invention a railway turnout comprises two wing rails and a point, carried on a frog, which includes a nose, the running surface of which is substantially co-planar with the running surfaces of the rail of the turnout, the wing rails being provided with tread surface inserts inclined upwardly above the plane of the running surfaces, the incline of the wing rails extending longitudinally along the wing rails towards the heels thereof and commencing at a point corresponding to the point of deviation from the gauge line, of the wing rail, the tread surface of the wing rails being shaped, in cross section, from the edge adjacent the gauge line, at an angle corresponding to the shape of the average worn car wheel and the angles of the incline and the slope being dependent on the taper on the wheels and on the angle of deflection of the turnout.

4 Claims, 4 Drawing Figures

RAILWAY TURNOUTS

This invention relates to railyway turnouts and in particular to the crossing where the wheels traverse the wing rail and the nose or point of the point rail.

In railway turnouts the wing rails are normally laid with a constant elevation while the point rail nose is provided with a reverse slope from a point lower than the plane of the wing rail. The car wheels are coned and in running across the crossing, encounter a position on the wing rail where the wing rail deviates from the direction of travel of the wheel or gauge line at the throat of the flangeway of the crossing rail.

The wheel drops as the point of contact between the rail and the wheel moves outwardly on the conical wheel tread and in dropping it encounters the nose, rides up the reverse slope and proceeds at the proper elevation, hammering the nose in the process.

It is an object of this invention to provide a solution to this problem by providing raised wing rails.

Rail road frogs using such raised wing rails have been proposed by Keough in U.S. Pat. No. 1,389,144 and Carruthers, U.S. Pat. No. 2,012,807. Keough suggests that the wing rail be raised or that the point be lowered to prevent the wheels striking the point and breaking it down. The raised wing rail is sketchilly described, but it appears merely to provide a ramp to lift the car wheels over the point of the nose, the frog depending more on a narrow flangeway to force the wheel tread on to the nose tread surface. Keough also proposes a deep wide throat which will tend to offset the advantage gained by the raised wing rail. Carruthers uses a frog in which the point is inclined above the plane of the stock rail tread surfaces, as are the wing rails. The height above the plane of the stock rails being determined by the expected ultimate displacement of surface metal as a result of cold flow thereof in an endeavour to obtain, once the metal has stabilised the proper elevation on the point rail in particular. The tread surface of the wing rails are horizontal with the result that a car wheel, in transferring from the wing rail to the nose, will place a substantially point load on the inner edge of the wing rail, notwithstanding that the wing rail is raised.

According to the invention a railway turnout comprises two wing rails and a point which includes a nose, the running surface of which is substantially co-planar with the running surfaces of the rail of the turnout, the wing rails being provided with tread surfaces inclined upwardly above the plane of the running surfaces, the incline of the wing rails extending longitudinally along the wing rails towards the heels thereof and commencing at a point corresponding to the point of deviation from the gauge line, of the wing rail, the tread surface of the wing rails being shaped, in cross section, from the edge adjacent the gauge line, at an angle corresponding to the shape of the average worn car wheel, and the angles of the incline and the slope being dependent on the taper on the wheels and on the angle of deflection of the turnout.

According to a further aspect of the invention, the wing rail inclination is provided by a tread surface insert which, in cross section, is provided with the slope described above and which is inclined from the toe to the heel of the crossing.

The cross-sectional shape of the wing rail may be altered by means of additive welding. Only the edge of the wing rail facing the point need be altered.

The insert is preferably of steel hardened to tool steel hardness.

According to yet a further aspect of the invention, the point, in cross section, may be rectangular. It will be appreciated that the rectangular point may be used in conjunction with the rectangular wing rails.

The nose is preferably carried on a frog comprising a main filler adapted to be bolted or otherwise secured between the vertical webs and base flanges of the wing rails, and a point filler comprising the point and a base, the main filler being formed with a recess adapted to receive the base of the point filler and the point being shaped to abut the severed point rails in use.

Figure 1:
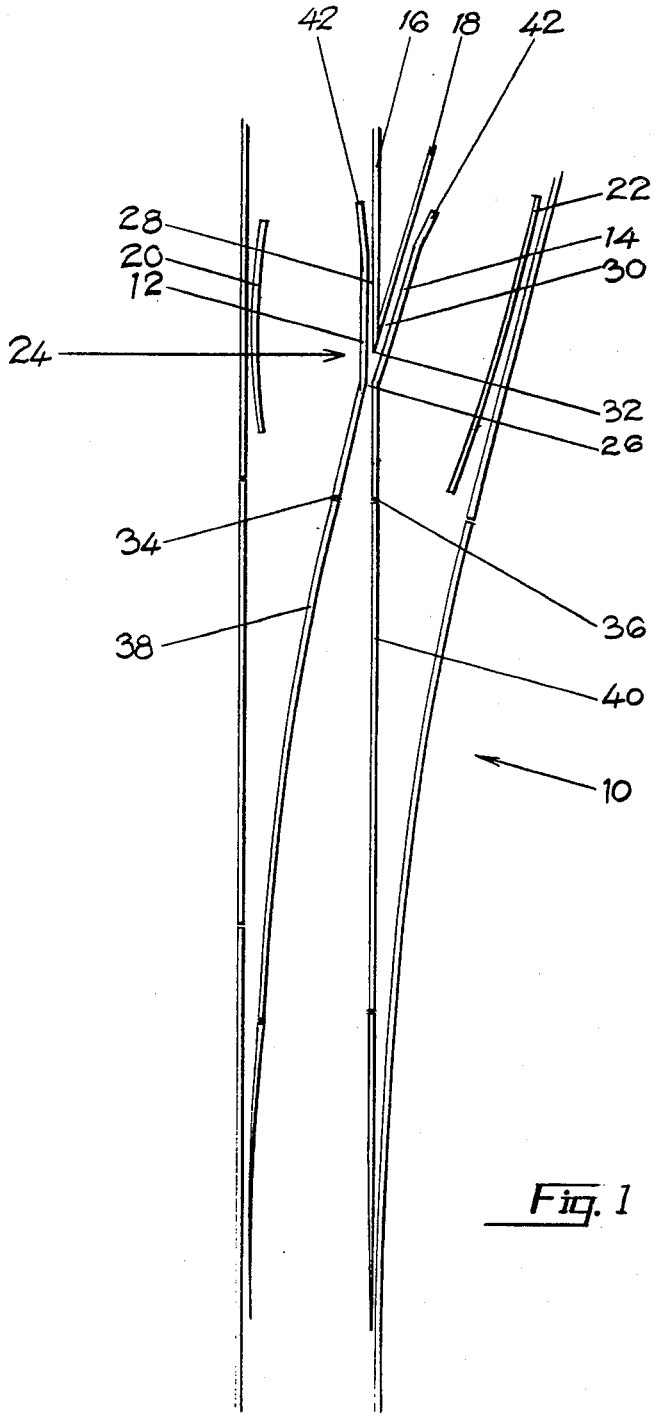
FIG. 1 is a diagramatic plan view of a prior art turnout showing the various parts thereof.

The prior art turnout 10 shown in FIG. 1 comprises a crossing 24 consisting of a left hand wing rail 12, a right hand wing rail 14, a point or long point rail 16, a splice rail or short point rail 18 and two guard rails 20, 22. The wing rails 12, 14 define a throat 26 for two flangeways 28, 30. The short point rail 18 is slanted and abuts the long point rail 16 which is provided with the point 32. The toes 34, 36 of the wing rails 12, 14 abut the siding rail 38 and the main line rail 40 while the heels 42 are at the free ends or runout ends of the wing rails.

Figure 2:
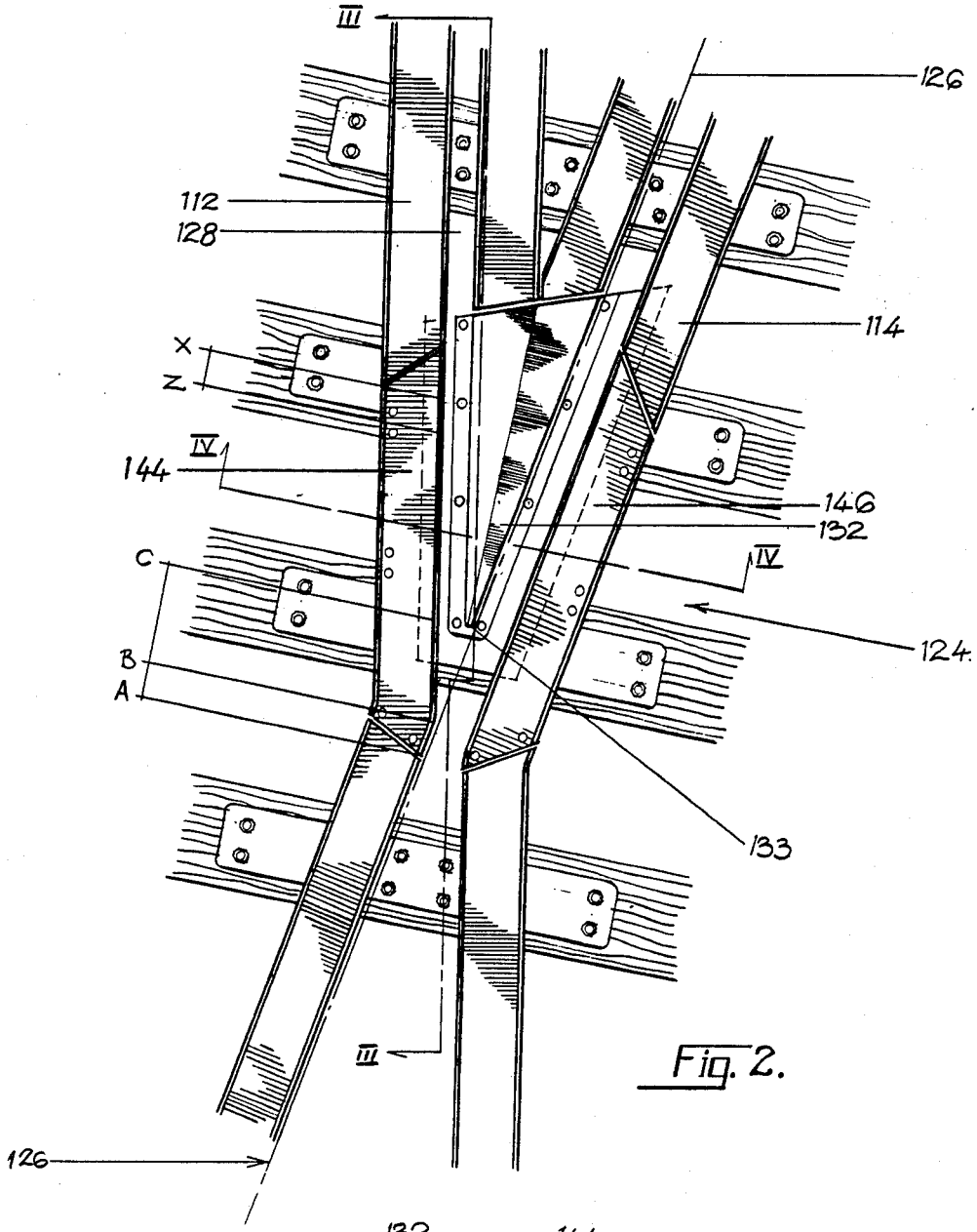
FIG. 2 is a plan view of the crossing of the turnout of the invention.

The crossing of the invention (denoted generally by the numeral 124) is shown in more detail in FIG. 2. In this specification the term "gauge line" is used to denote the imaginary line followed by the flange of a car wheel running along the rail. The gauge line is normally co-extensive with or closely adjacent the inner edge of the head of the rail but it may deviate from this position particularly on turns and in crossings. For the sake of clarity only the one gauge line is shown in chain line 126. It is an imaginary line indicating the path followed by the wheel flange of a car wheel traversing the crossing 124 from left to right. The problem associated with the prior art is well illustrated by following the gauge line 126 from the bottom of the drawing to the top. As the wheel negotiates the gap (B-C), the entrance to the flangeway 128, the wing rail 112, and therefore the support beneath the wheel, is deviating from the gauge line 126 at a given angle (depending on the angle of deflection of the turnout and, due to the coning of the wheels, the wheel comes down in elevation. At this point the wheel meets the nose 132, changes direction, on the reverse slope of the prior art point, and continues on its way. The point 133, which is, by nature of its function, a narrow tapered piece of metal, is rapidly worn away by the repeated hammer blows.

It is proposed to arrange the wing rails 112, 114, so that they are inclined upwardly from their point of departure from the gauge line 126. This is done by the provision of wing rail inserts 144, 146 which are inclined along a first horizontal axis from the toe to the heel of the wing rails 112 114 as can be seen from the elevation in FIG. 3. In this manner the drop in elevation of the wheel is countered by a corresponding raising of the wheel by the wing rail inserts 144, 146, so that the tyre of the wheel is on a plane with the tread surface of the point 133 at the point of contact. It is anticipated that the lessening of the impact achieved by the raising of the wing rails will prolong the life of the point 133 and nose 132 substantially.

Figure 3:
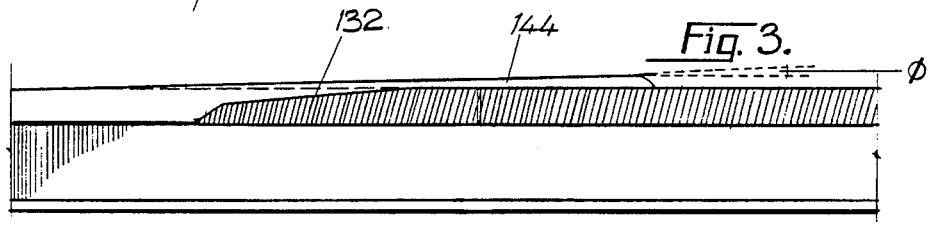
FIG. 3 is a section on line III—III in FIG. 2.

The raising of the wing rail can be clearly seen in FIG. 3 where the tread surface of the wing rail 112 is shown to depart from the plane of the other rails in the turnout by an angle $\phi$, which will, of course, vary for every turnout angle as well as the angle of taper of the wheel, but is merely a matter of calculation.

Figure 4:
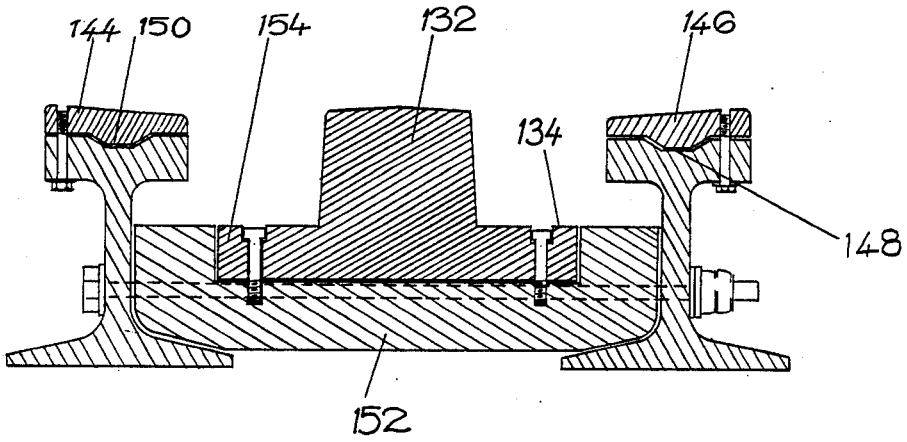
FIG. 4 is a section on line IV—IV in FIG. 2.

The rounded edges of the rail heads reduce the horizontal tread surface of the rail in the crossing 124, the effective point of first contact between the tread surface of the rail head and the tyre being inwardly of the rail edge and conversely, of the gauge line 126. This means that the contact point between the wing rail 112 and the wheel starts moving away from the flange before the point B and in fact the contact points start deviating at a point A as the wheels traverse the crossing 124. By providing the tread surfaces of the inserts 144, 146, with a rectangular profile or a sharp inner edge, as shown in FIG. 4, the distance A-B is added to the running surface of the rail. In a 1:9 turnout the added support length is approximately 100 mm. The same distance, by the same token is added at the run-off edge of the insert (distance X-Z).

The point 133 is also rectangularly profiled in this manner. The nose 132, is standard, the tapered sides being necessary to prevent a derailment. However, once a point is reached where the wheel is in the flangeway, the sides of the nose are angled towards the vertical crowned rectangular profile as is shown in FIG. 4, thereby adding running surface to the rail in the same manner as is achieved by the profiling of the wing rails 112, 114.

The inserts 144, 146 are keyed and material is removed from the wing rail heads to accept the inserts, the recesses so formed being provided with grooves 148 to accept the keys 150 on the inserts whereby the latter are located on the wing rails and secured by means of bolts.

The inserts 144, 146, instead of having horizontal tread surfaces are sloped upwardly along a second horizontal axis normal to said first horizontal axis from the inner edges of the wing rails 112 and 114 so that, instead of a point contact between the coned wheel and rail, a line of contact is established. The wheel rim is therefore supported on the whole of the rim surface remaining above the wing rail instead of merely the edge of the wing rail. The slope of the insert is, of course, commensurate with the profile of an average worn wheel. The point 133 and nose 132 are integrally formed on a point insert 134 which is carried on a frog 152 which may be cast or machined from a block. The frog 152 is carried on the base flanges of the wing rails and abuts the vertical webs. The frog is transversely bolted through the webs of the wing rails and formed with a recess into which the point insert 134, which is provided with a base 154, is adapted to fit. The point insert base 154 is secured into the recess by means of Allen screws.

The heel of the frog 152 and the point insert 134 is slanted and abuts the ends of the long and short point rails 116 and 118 which are slanted to accept the frog and point insert. Once inserted and bolted the frog 152 is therefore is securely located in between the wing rails.

Replacement of the wing rail and point inserts is merely a matter of the removal and replacement of a set of bolts and screws, the slanted ends and keys of the wing rail inserts and the definitive shape of the point insert recess in the frog 152 as well as the slanted heel of the point insert, ensuring the accurate location of the various elements.

The three inserts 144, 146 and 134 are made of tool steel hardness further to increase their wear resistance capability.

I claim:

1. A railway turnout comprising a main line rail, a siding rail, two wing rails, and a nose terminating in a point, said main line and siding rail having intersecting gauge lines convergent along the main line and siding rails, crossing ahead of the point and diverging from the point rearwardly along the nose, the wing rails abutting the main line rail and the siding rail, respectively at one end of each, the other end of each wing rail being free, each wing rail having two horizontal axes, a first axis of which extends longitudinally along the wing rail and a second axis of which is normal to the first axis, the running surface of the nose being substantially co-planar with the running surfaces of the rails in the rest of the turnout and the wing rails being provided with tread surfaces which are inclined above the plane of the running surfaces along said two horizontal axes, the inclination along the first axis on each wing rail extending longitudinally along the wing rail towards the free end thereof and rising to a high point from a low point where the wing rail deviates from the gauge line of the associated main or siding rail, and the inclination along the second axis commencing from an inner edge, adjacent the gauge line of each wing rail and extending upwardly away from the inner edge, the angles of inclination on said first and second axes being dependent on the angle of deflection of the turnout, the shape of an average worn car wheel and the taper on wheels which are to use the turnout.

2. A turnout according to claim 1 in which the inclinations on the wing rails are tread surface inserts, each of which, in cross section, is provided with a slope arranged, in use, to extend upwardly from the inner edge of the wing rail to an opposite outer edge of the wing rail at an angle corresponding to the shape of the average worn car wheel.

3. A turnout according to claim 1 in which the inclinations on the wing rails are tread surface inserts, each of which, in cross section, is provided with a slope arranged, in use, to extend upwardly from the inner edge of the wing rail to an opposite outer edge of the wing rail at an angle corresponding to the shape of the average worn car wheel, the insert being of steel of tool steel hardness.

4. A turnout according to claim 1, including a frog located between vertical webs of the wing rails, said nose and point being integrally formed in a point insert which includes a base, said frog having a complemental recess in which said base is fitted.

* * * * *